United States Patent [19]

Powell et al.

[11] 4,428,815

[45] Jan. 31, 1984

[54] VACUUM-TYPE ARTICLE HOLDER AND METHODS OF SUPPORTIVELY RETAINING ARTICLES

[75] Inventors: Walter W. Powell, Peculiar; Gary A. Seifert, Lee's Summit, both of Mo.

[73] Assignee: Western Electric Co., Inc., New York, N.Y.

[21] Appl. No.: 489,448

[22] Filed: Apr. 28, 1983

[51] Int. Cl.[3] ..... C25B 9/02; A45D 42/14; B60G 11/32

[52] U.S. Cl. ..... 204/297 W; 248/362; 269/21

[58] Field of Search ..... 204/297 R, 297 W, 297 M; 248/362; 269/21

[56] References Cited

U.S. PATENT DOCUMENTS

| | | | |
|---|---|---|---|
| 3,481,858 | 12/1969 | Fromson | 204/297 |
| 3,536,594 | 10/1970 | Pritchard | 204/27 |
| 3,558,093 | 1/1971 | Bok | 248/362 |
| 4,043,894 | 8/1977 | Gibbs | 204/297 W |
| 4,213,698 | 7/1980 | Firtion et al. | 355/77 |

FOREIGN PATENT DOCUMENTS

| | | | |
|---|---|---|---|
| 2908788 | 9/1979 | Fed. Rep. of Germany | 204/297 W |
| 55-121647 | 9/1980 | Japan | 204/297 M |

*Primary Examiner*—F. Edmundson
*Attorney, Agent, or Firm*—W. O. Schellin

[57] ABSTRACT

A vacuum-type holder (10) for retaining fragile articles such as semiconductor wafers (16) during a manufacturing operation, such as an electrolytic treatment includes a vacuum-operated support (36) at each of the seats (23) which exerts a supporting force against the underside (32) of the wafer (16) which is opposite to and proportional to a vacuum generated holding force which urges the wafer against the seat. The supporting force, consequently, minimizes bending stresses to which the wafer (16) could otherwise be subjected.

18 Claims, 4 Drawing Figures

VACUUM-TYPE ARTICLE HOLDER AND METHODS OF SUPPORTIVELY RETAINING ARTICLES

FIELD OF THE INVENTION

This invention relates to a vacuum-type article holder and to methods of supportively retaining articles by forces generated by a vacuum. This invention advantageously applies to an article holder for and to methods of supportively retaining articles which are fragile, such as seimconductor wafers. Such wafers are comparatively thin with respect to their size and are therefore likely to become damaged through improper handling techniques.

BACKGROUND OF THE INVENTION

The invention is particularly described in relationship to a vacuum-type wafer holder for holding semiconductor wafers in an electrolytic treatment operation. However, the described details of the invention in relationship to particular examples are to convey a full understanding of the features of the invention and are not intended to be limiting to the scope of the invention. Therefore, articles other than semiconductor wafers and handling processes other than electrolytic treatments are seen to be advantageously improved by the invention.

Semiconductor wafers are typically thin (20 mils) slices of single-crystal material which serves as the starting material for various types of semiconductor devices. In a series of production steps, a large number of small semiconductor circuits are formed within the body of such wafers. At the conclusion of the device-forming production steps, the wafers are cut into small chips, each chip being one of the semiconductor devices.

The production steps typically make use of high-resolution photolithographic processing techniques including electrolytic plating and etching steps. Handling the wafers throughout the various process steps is always of concern, in that defects introduced during any of the process steps reduce the yield of good chips from each wafer and thereby raise the cost of the remaining chips. It is, therefore, of utmost concern to minimize the introduction of manufacturing defects.

For example, the yield of good chips is likely to be affected by merely accidentally touching a wafer with bare hands or by contacting a wafer with handling tools in an unusual manner during any one of the various process steps. surface smudges on the wafers or depositions of dust particles on the surfaces of the wafers are typical causes of yield problems. Therefore, automated handling processes have been developed wherein contamination by smudges or dust particles has been minimized. These automated handling processes frequently involve the use of vacuum forces to retain the wafers.

As an example, U.S. Pat. No. 3,558,093 to H. F. Bok relates to a vacuum memory holding device of the type used as a tray for supporting a plurality of wafer-like objects in a spray-coating chamber. The holding device includes a vacuum chamber, one wall of which resiliently collapses against springs as the vacuum is generated in the chamber to hold the vaccum in the chamber.

Another example of a vacuum-operated work holding device is disclosed in U.S. Pat. No. 3,481,858 to H. A. Fromson. According to the Fromson patent, a workpiece to be subjected to an electrolytic operation is held by a suction cup. A vacuum passage terminating at the suction cup is normally closed by a spring-loaded valve and pin combination. When the vacuum cup is pressed against the surface of the article, the pin is pushed into contact with the article and the vacuum valve to the suction cup is opened. The pin also establishes electrical contact with the article which is electrically insulated from the ambient by the surrounding vacuum cup.

In the above-mentioned examples of vacuum holders, maintaining the planarity of the articles is of no concern. However, in processing semiconductor wafers into state-of-the-art integrated circuits, holding the wafers without disturbing their planarity has been recognized as being of significance in photolithographic exposure steps. U.S. Pat. No. 4,213,698 to V. T. Firtion et al. relating to apparatus and method for holding and planarizing thin workpieces, discusses the significance of maintaining the planarity of thin semiconductor wafers in pattern exposure operations.

The above-mentioned Firtion et al. patent discloses a wafer holder featuring a seat of a plurality of pin-like extensions from a baseplate. The ends of the extensions terminate in a plane, and a compressible seal surrounds the extensions. Thus, after a wafer is placed onto the seat, a vacuum is drawn in the space about the extensions. The wafer is drawn against the ends of the extensions and thereby becomes supported with a high degree of planarity. The relatively small support area between the extensions and the wafer minimize the possibility of dirt particles from becoming trapped between the supporting extensions and the wafer in that such dirt particles might disturb the planarity of the wafer.

It now appears that yield-reducing defects may be generated during process steps other than the pattern exposure operations when the wafers are held by vacuum in a manner which tends to induce a bow or other strain into the wafers. It appears, for example, highly advantageous to support the wafers with as little strain on the wafers as possible during all electrolytic treatments such as plating or etching.

SUMMARY OF THE INVENTION

In accordance with the invention, a vacuum-type holder for an article includes a housing which encloses at least one vaccum cavity. The vacuum cavity has at least one opening through a wall of the housing, such that the opening is located within the confines of a seat adapted to retain the article when a vacuum is drawn within the cavity. The cavity is adapted to be coupled to a vacuum. A structure is movably mounted within the cavity. The structure includes a provision for contacting and supporting the article through the at least one opening with a supporting force opposite and proportional to a retaining force acting on the article in response to the vacuum within the cavity.

BRIEF DESCRIPTION OF THE DRAWING

Various features and advantages of the invention are best understood when the following detailed description is read in reference to the appended drawing, wherein.

DETAILED DESCRIPTION

Figure 1:
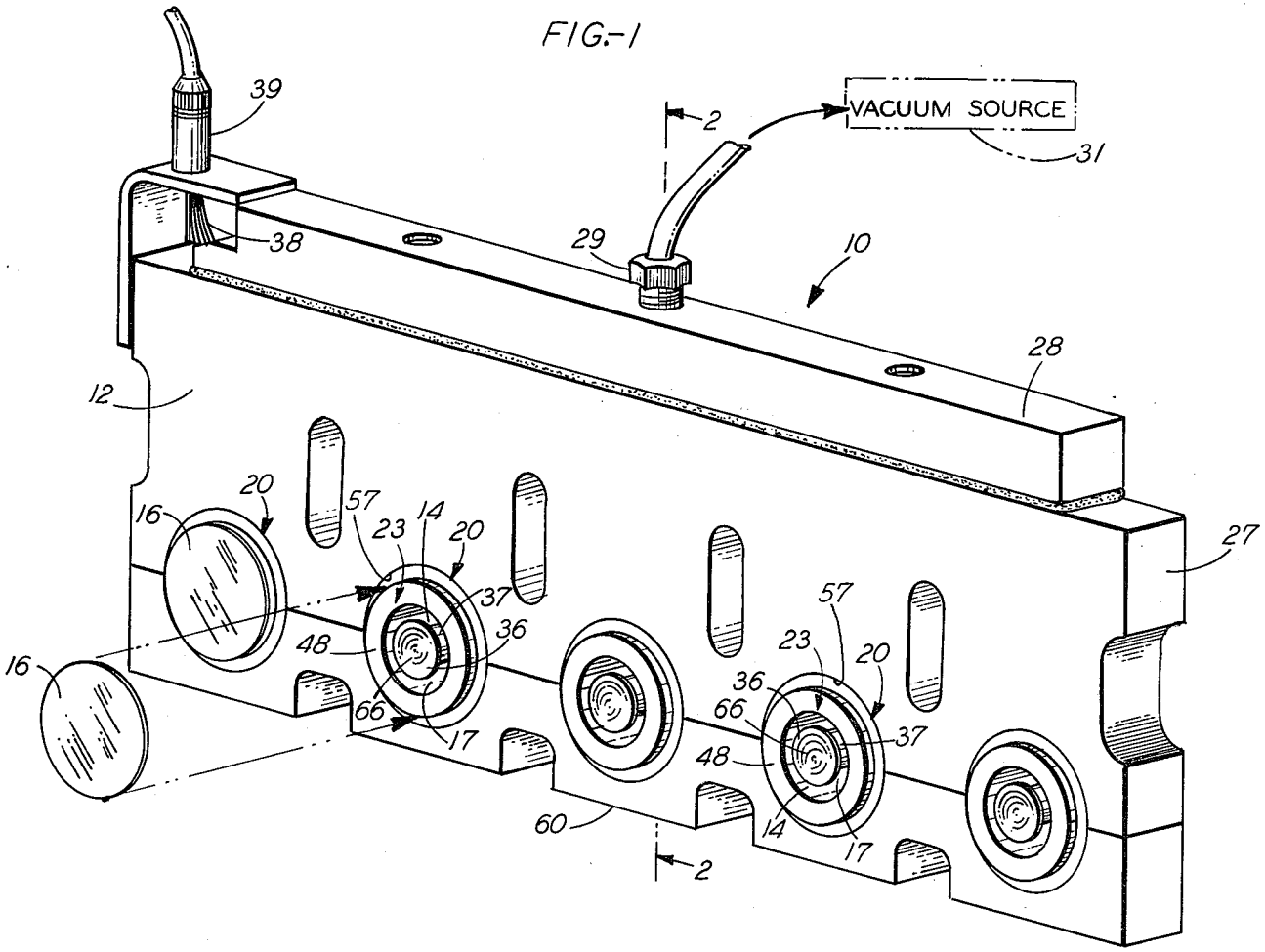
FIG. 1 is a pictorial representation of a wafer holder showing features of the present invention.

Referring to FIG. 1, there is shown an article holder, specifically a wafer holder, designated generally by the numeral 10, which is described herein as a preferred embodiment of the invention. The wafer holder 10 has a body or housing 12, preferably of a material such as an acrylic or polyvinyl chloride. Such materials are electrical insulators and are inert to typical plating baths. A lower portion of the plate-shaped housing 12 features a plurality of cavities 14 of circular topography, slightly smaller in diameter than the diameter of wafers 16 which are to be seated and held in place over each of the respective cavities 14.

Without one of the wafers 16 in place over a corresponding one of the cavities 14, the cavity 14 is a circular cylindrical recess in the body 12 of the holder 10. For a vacuum to be drawn in the cavity, one of the wafers 16 needs to be placed over an opening 17 of the respective cavity 14.

Figure 4:
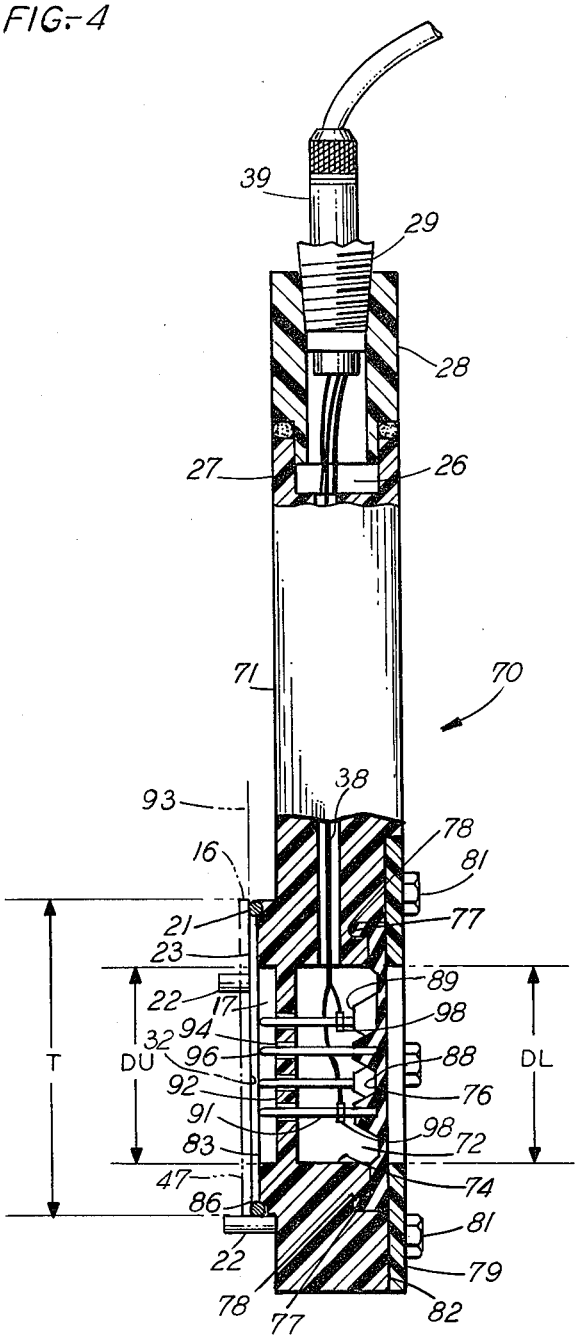
FIG. 4 shows an alternate embodiment of certain features of the invention.

Modifications may, of course, be made in various details of the structure without departure from the scope of the invention. For example, in the embodiment of FIG. 1, the cavities 14 are located in and defined by molded cavity members 20 which are preferably of a resilient, protecting and sealing material, such as silicone rubber. A plurality of the molded cavity members 20 are assembled into the holder 10 as shown in FIG. 1. FIG. 4 shows an alternate embodiment of a cavity wherein the cavities 14 are directly within the housing and a separate sealing member, such as an O-ring 21, is partially embedded into the housing. Locating pins 22, preferably of the same, inert material as the housing, are alternatively supplied, as shown in FIG. 4, to eatablish lateral boundaries of seats 23, such that the wafers 16 may be aligned more readily over the openings 17.

Figure 2:
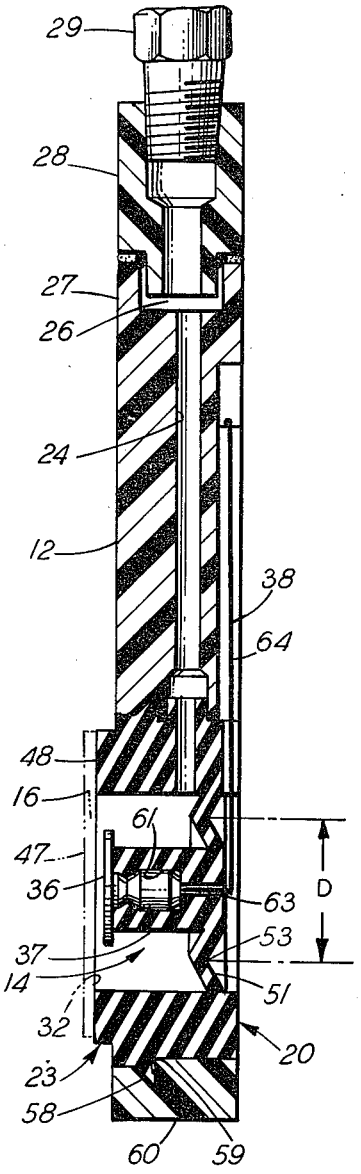
FIG. 2 is a sectional view of the wafer holder of FIG. 1 showing details of a vacuum cavity and a respective seat for one of the wafers with the pressure in the cavity being equal to that of the ambient.

In reference to FIG. 2 showing a section through the holder 10 of FIG. 1, a vacuum suction duct 24 leads from each of the cavities 14 to a common manifold chamber 26 in an upper portion 27 of the housing 12. As becomes apparent from FIG. 1, the manifold chamber preferably extends substantially the length of the housing 12 as an elongate recess in the upper portion 27 of the housing 12. The recess is then closed off, as shown in FIG. 1, by a sealing cover plate 28 having a single vacuum line coupling 29, which in turn, is then coupled to a typical vacuum source 31.

Inasmuch as the articles, namely the wafers 16, which are placed onto the seats 23 are to be treated electrolytically, an electrical contact to the wafers 16 is preferably established to the backsides 32 of the wafers 16 which are the inner surfaces facing the cavities 14. As shown in FIG. 1, a contact element 36 is mounted on a pedestal 37 in the center of each of the cavities 14. In reference to FIGS. 1 and 2, an electrical, insulated lead 38 is routed from each of the cavities 14 to an electrical connector 39 at the top of the housing 12.

Figure 3:
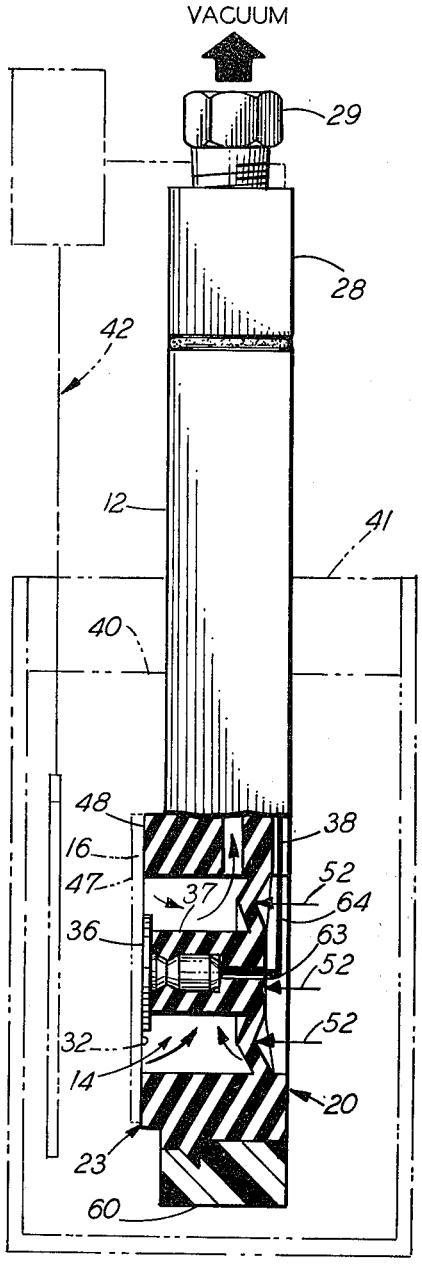
FIG. 3 is a sectional view of the wafer holder of FIG. 1 showing details of a vacuum cavity in relationship to a respective wafer when a vacuum is established within the cavity.

In a typical electrolytic treating operation such as, for example, a metal plating operation, the wafers 16 are placed onto the seats 23 and a vacuum is drawn in the cavities 14 to hold the wafers 16 in place and to establish electrical contact between the contact elements 36 and the wafers 16 (see FIG. 3). The holder 10 is then partially submersed in an electrolytic bath 40 of a plating tank 41, as shown in FIG. 3, to place the wafers 16 into an electrolytic treating circuit 42.

Particular features and advantages of the invention are best explained in reference to FIGS. 2 and 3. For example, a firm electrical contact between the contact element 36 and the adjacent surface 32 of the wafer 16 is highly desirable to reliably obtain an electrolytic treatment of predictable quality on an outer surface 47 of the wafer 16. However, to protect the wafer 16 from possibly becoming damaged while being loaded onto the seat 23, it is also desirable to recess the contact element 36 below a mounting surface 48 of the seat 23. In addition, it is desirable to minimize strain on the wafer during the electrolytic surface treatment. Such strain tends to occur when the vacuum is applied for holding the wafer and for urging it toward and into contact with the contact element 36.

FIG. 2 is a section through a representative one of the seats 23 and through the associated cavity 14 including the pedestal 37 and the contact element 36. As shown in FIG. 2, the pedestal 37 extends from an inner surface of a resiliently flexible diaphragmatic wall 51 through the cavity 14 toward the seat 23. Without a vacuum drawn in the cavity 14, the contact element 36 has its normal rest position below the mounting surface 48 of the seat 23, as shown in FIG. 2. Thus, when a wafer 16 is placed onto the seat 23 with some sliding motion to move it into a well-centered position over the cavity 14, the inner surface 32 of the wafer 16 (see also FIG. 3) is prevented from accidentally scraping across the contact element 36.

Once the wafer 16 is positioned on the seat 23, and a vacuum is drawn in the cavity 14, as shown in FIG. 3, the pressure differential across the wall 51 having a relatively greater pressure, as indicated by arrows 52, on the outside of the wall flexes the wall 51 and, hence, urges the pedestal 37 toward the seat 23 and urges thereby the contact element 36 firmly into contact with the adjacent, inner surface 32 of the wafer 16.

Referring particularly to FIG. 3, the wafer 16 is pulled by the vacuum toward the cavity 14 and into firm, sealing contact with the mounting surface 48 of the seat 23. It should be realized that in the absence of a support in the cavity 14, the wafer 16 would tend to become strained toward the cavity 14, such that the wafer 16 would assume a concave shape.

However, the contact element 36 pushes against the adjacent inner surface 32 of the wafer 16 and, hence, urges the wafer outward woth a force opposite to, and ideally only nominally less than, the inward pressing force on the wafer 16. As a result, the contact force between the contact element 36 and the adjacent surface 32 of the wafer 16 is positive and firm, while the supporting force by the contact element 36 at the same time balances out the inward force on the wafer 16, such that the planarity on the wafer is substantially preserved.

The magnitude of the supporting counterforce exerted against the wafer 16 by the contact element depends on the particular geometry of the pedestal and on that of the diaphragmatic wall 51. Referring to the geometry of the preferred embodiment shown in FIG. 2, a differential pressure force acting on the wall 51 within a circle indicated by the diameter 'D', namely in the area bounded by a knee 53 in the wall 51, is substantially equal to the total counterforce exerted against the inner surface 32 of the wafer 16. Since this supporting force is applied to the center of the wafer 16 and the periphery of the wafer is, of course, supported by the mounting surface 48 of the seat 23, only a comparatively narrow, annular region of the wafer 16 remains unsupported. As a result, wafers 16 when supported by the described structure of the wafer holder 10 show no discernible deviation from their flatness.

The preferred embodiment of FIGS. 1, 2 and 3, because of its structure is readily assembled and serviced. The molded cavity members 20 are unitary structures of resilient silicone rubber which are readily inserted into outer support apertures 57 of the housing 12. A ledge 58 about the periphery of each of the molded members 20 fits into a corresponding annular groove 59 in the respective support aperture 57 to securely retain the inserted portion thereon. A lower removable housing portion 60 facilitates the insertion of the cavity member 20 into the support apertures 57. The contact element 36 is preferably inserted into the pedestal 37 prior to the insertion of the cavity members 20. The contact elements 36 fit into appropriately provided recesses 61 in the pedestals 37, and insulated electrical leads or conductors 38 are inserted through central base openings 63 in the pedestals after the members have been inserted into the housing 12. Insulative jackets 64 of the conductors 38 when pushed into the base openings 63 seal these openings to prevent electrolytic fluids from contacting the conductors 38 or the contact elements 36 during subsequent usage of the wafer holder 10. A room temperature vulcanizing silicone rubber compound may be used in addition to seal the base openings 63 after the conductors 38 have been inserted therein.

An advantage of such unitary, molded members 20 is realized in the ease replacing the conductors 38 or even the molded members 20 as such, should they become contaminated or should the contact members 36 become corroded. Another advantage is that the molded members 20 can be replaced by molded members of different shapes or sizes, so that the wafer holder 10 can be used as a universal structure for holding wafers or other articles of various sizes and shapes. To adapt the wafer holder 10 to support wafers 16 of different diameter, the molded members 20 are removed from the housing 12 and are simply exchanged for molded members having a seat 23 of a larger, or of a smaller diameter, as the case may be.

It should be realized, of course, that various other changes and modifications can be made to the described preferred embodiment of the invention, without departing from the spirit and scope of the described invention. For example, the diameter of the contact element 36 may be increased or decreased without affecting the magnitude of the counterforce directed against the inner surface 32 of the wafer 16. The contact element 36 may also be provided with a plurality of contact bumps (not shown) on an upper contact surface 66 of the element 36. In one embodiment, the disk-like contact surface 66 is conically concave to provide an annular contact with the inner surface 32 of the wafer 16. While such a modification locally increases the contact pressure exerted by the contact element 36 against the wafer 16, it again does not alter the magnitude of the counterforce directed against the wafer 16. The magnitude of such counterforce tends to relate directly to a vacuum of a particular magnitude generated in the respective cavity 14.

FIG. 4 shows a wafer holder designated generally by the numeral 70. The wafer holder 70 represents an alternate embodiment of the invention. Structural elements of the wafer holder 70, which function substantially like corresponding elements of the wafer holder 10 are identified by the same numerals as those of the wafer holder 10.

A body or housing 71 determines the structural boundaries of the holder 70. The housing 71 differs from the housing 12 in that a vacuum cavity 72 is formed directly in the housing 71, instead of in a molded, unitary vacuum seat and cavity member 20 as shown in FIG. 1. However, a plurality of such vacuum cavities 72 are located in the housing 71 in the same arrangement as the cavities 14 are arranged in the housing 12 of FIG. 1. Consequently, the sectional view of FIG. 4 represents, as to the arrangement of the cavities in the holder, an equivalent to the section through the vacuum holder 10 shown in FIG. 2.

Each of the vacuum cavities 72 in the holder 70 is bounded by a cylindrical wall 74 of a bore into the housing 71. A rear portion of such cavity 72 is sealed by a resiliently flexible diaphragm 76. The diaphram 76 is preferred to be a molded, substantially planar disk. A peripherally molded ridge 77 on one surface of the diaphragm matches a circular recess 78 in the housing 71. A retainer ring 79 is mounted, preferably by a plurality of plastic mounting screws 81 to a back surface 82 of the housing 71 to retain the diaphragm in sealing contact with the housing.

A seat 23 for holding an article such as the wafer 16 is formed on a front surface 83 in concentricity with the wall 74 of each of the cavities 72. A plurality of the pins 22 are typically spaced about each of the seats 23 to retain the wafer 16 in position when such wafer is first loaded onto the respective seat and before a vacuum becomes established in the cavity 72.

An annular groove 86 in the housing 71 is concentric with each respective cavity 72 and is located within the bounds established by the pins 22 of the respective seat 23. O-rings 21 which are retained in the grooves 86 resiliently support the wafers 16 when they are placed onto the seats 23. The O-rings 21 further provide a vacuum tight seal between the wafers 16 and the housing 71 when a vacuum is drawn in each of the cavities after the wafers 16 have been loaded onto the seats 23. The vacuum becomes established in the cavities 72 in the same manner as already described with respect to the wafer holder 10. A manifold chamber 26 in the upper portion 27 of the housing 71 joins a plurality of vacuum suction ducts 24, each one of which leads through the housing to a respective one of the cavities 72. The manifold chamber is sealed off by the cover plate 28.

The electrical connector 39 for a plurality of electrical leads 38 leading to the cavities 72 is preferably mounted with a vacuum tight seal in the coverplate 28. From the connector, the leads 38 are routed through the manifold chamber 26 and through each of the vacuum suction ducts to the respective vacuum cavities 72.

An inner surface 88 of each diaphragm 76 features a plurality of uniformly spaced blind mounting grommets 89 as integrally molded details of the diaphragm 76. The grommets serve as mounting bases for a plurality of support pins 91 which are inserted into the grommets 89 and extend perpendicularly from the diaphragm 76 toward the seat 23. Because of the resiliency of the diaphragm 76 the pins 91 are preferably guided. A pin guide 92 is an apertured plate adjacent to and offset toward the cavity 72 from a plane 93 wherein a wafer 16 becomes located on the seat 23.

Apertures 94 in the guide 92 coincide with projections of the mounting grommets 89 normal to the plane of the diaphragm 76 toward the seat 23. The guide 92 is preferred to be an integral part of the housing 71. However, the guide 92 may also be provided as a separately maunfactured element. The guides 92, when they are such separate elements, are then subsequently inserted into or mounted to the seats 23 in the housing 71.

The support pins 91 have a predetermined length which locates upper ends 96 of the pins 91 within the respective cavity 72 and adjacent to, but spaced from, the locating plane 93 of the wafers 16. Thus, when the diaphragm 76 is in its rest position, namely in the absence of a vacuum in the cavity 72 of the holder 70, a wafer 16 may be placed onto the respective seat 23 without the wafer contacting any of the pins 91. However, as soon as a vacuum becomes established in the cavities to retain the wafers 16 which have been loaded onto the seats 23, the diaphragm 76 moves inward, toward the cavity 72 and urges the pins 91 against the inner surface 32 of the wafer 16.

The described features of the invention in relationship to the holder 70 serve as an excellent example to highlight certain advantages over those of prior art article holders. Prior art wafer holders do make use, for example, of a plurality of uniformly spaced support pins mounted in a vacuum cavity to support wafers with a distrubuted support and yet with minimal contact area. Such minimal contact area tends to minimize the probability of dirt particles from becoming lodged on such contact surface areas to disturb the planarity of the contact area. to establish the planarity of the contact surface area in prior art wafer holders, the tops of the pins of such prior art holders are lapped with respect to each other to a high degree of planarity.

As can be realized from the above description in reference to the FIG. 4, such high degree of planarity between upper ends 96 of the pins is no longer necessary since the pins 91 are capable of movement toward and away from the inner surfaces 32 of the wafers 16. As a vacuum becomes established in the cavities 72, the upper ends 96 of the pins 91 are urged into contact with the inner surfaces 32 of the respective wafers 16 on the holder 70. The total supporting force directed against the inner surface 32 of each wafer 16 is the result of the differential pressure across the diaphragm 76, resulting from a difference between the ambient pressure and a low partial pressure of the so-called vacuum in the respective cavity 72.

The total force exerted by the pins 91 against the inner surface 32 is consequently related to the net pressure against the diaphragm 76 and to the effective area of the diaphragm 76 as indicated by the dimension "DL" in FIG. 4. The total force exerted by the pins 91 is, however, counteracted and totally offset by an identical pressure-related force directed against a portion of the outer surface 47 of the wafer 16. This latter portion is indicated by the diametral dimension "DU" in FIG. 4. If the total force acting against the outer surface 47 is related to the pressure differential and the surface area of the wafer 16 within the O-ring as shown by the dimension "T", then a substantial portion of the vacuum related holding forces on the wafer 16 are supportively balanced by the pins 91, so that bending stresses on the wafer 16 are minimized.

A particular advantage of the described embodiment resides in that a dirt particle may now become lodged on the upper end 96 of one of the pins 91 without disturbing the planarity of the wafer 16 when the vacuum is applied to the cavity 72. The force of the pin 91 which is exerted against the inner surface through the dirt particle is substantially identical to the force transmitted to the wafer 16 through the pin directly without the dirt particle. The balance of forces has not been changed through the presence of the dirt particles as it would have in the case of rigidly mounted and planarized pins.

Another advantage of the described features becomes apparent when it is realized that the inner surfaces 32 of the wafers 16 are the backsides of ultimate circuits, and it is advantageous to pay less attention to their cleanliness and hence to their planarity. Thus, in prior art holders the surfaces of which had been lapped to a high degree of planarity, stresses and strains may have been introduced in wafers 16 because of defects in planarity on the inner surfaces 32 of the wafers 16. The described wafer holders 10 and 70 afford a balanced supporting force against the inner surface 32 of the mounted wafer 16 regardless of any topographical imperfections on such inner surface.

To avoid a loss in electrical contact of the inner surface 32 to the electrolytic treating circuit 42 (see FIG. 3), the electrical lead 38 is preferably split into several leads 38 within each of the cavities 72, as shown in FIG. 4, so that redundant connections 98 can be made to more than one of the pins 91. Various other changes and modifications may, of course, be made without departing from the spirit and scope of the invention.

What is claimed is:

1. A vacuum-type holder for at least one article, which comprises:

a housing including walls defining at least one vacuum cavity;

at least one seat formed on an external surface of said housing, said seat being adapted to receive one such article;

at least one opening in said housing communicating between said vacuum cavity and said seat;

means for coupling the cavity to a vacuum source for generating a vacuum within said cavity; and means, movably mounted within said cavity, for moving into contact with and for supporting said article through said at least one opening with a supporting force opposite and proportional to a retaining force acting on said article, both the supporting force and the retaining force being substantially proportional to the magnitude of a vacuum within said cavity and acting on said article in response to the vacuum.

2. A vacuum-type holder according to claim 1, wherein said means for moving into contact and for supporting said article comprises:

a resiliently flexible wall enclosing said cavity oppositely across from said at least one opening communicating between said vacuum cavity and said seat; and at least one contact element mounted to said flexible wall and extending from said flexible wall through said cavity and toward said at least one opening and said seat, such that in response to placing an article on the seat and generating a vacuum within said cavity, said flexible wall becomes flexed toward said cavity and said seat, and said at least one contact element is urged into contact with an adjacent surface of said article to support such article with a force opposing the urging force acting on the article in response to the vacuum.

3. A vacuum-type holder according to claim 2, wherein at least one seat formed on an external surface of said housing is a plurality of spaced seats, and wherein at least one opening in said housing is a plurality of openings, one such opening communicating between said vacuum cavity and one of such plurality of spaced seats.

4. A vacuum-type holder according to claim 3, wherein at least one contact element is a plurality of contact elements, each one of said plurality of contact elements extending toward and at least partly into one of such openings.

5. A vacuum-type holder according to claim 4, wherein said contact elements are electrically conductive and wherein said holder further includes means, coupled to said contact elements and adapted to be coupled into an electrolytic treating circuit, whereby said surface of said article, adjacent to said contact element becomes adapted to be coupled to such treating circuit when the contact element is urged into contact with the adjacent surface.

6. A vacuum-type holder according to claim 5, wherein the at least one article is a plurality of semiconductor wafers, the wafers being capable of supporting a treating current in response to said contact element being urged into contact with adjacent surfaces of said wafers and the outer surfaces of such wafers being contacted by an electrolytic treating fluid coupled to said electrolytic treating circuit.

7. A vacuum-type holder according to claim 2, wherein at least one contact element is a plurality of contact elements extending toward said seat.

8. A vacuum-type holder according to claim 7, further including means for coupling at least one of said plurality of contact elements to an electrolytic treating circuit.

9. A vacuum-type holder according to claim 8, wherein said article is a semiconductor wafer and wherein the semiconductor wafer, upon being placed upon said seat and upon a vacuum being generated in said cavity, is held on said seat by the retaining force generated by said vacuum source, is further supported by said plurality of contact elements and is coupled to said electrolytic treating circuit through contact by said plurality of contact elements.

10. A vacuum-type holder according to claim 9, wherein said at least one opening communication between said vacuum cavity and said seat is a plurality of openings, and each one of such plurality of contact elements extends toward a corresponding one of said plurality of openings, such that said openings guide said contact elements in their movement toward said seat.

11. A vacuum-type holder according to claim 10, wherein at least one cavity is a plurality of cavities, each cavity being spacedly located within said housing.

12. A vacuum-type holder according to claim 1, wherein the walls defining at least one cavity, at least one seat and means for moving into contact with and for supporting said at least one article comprise at least one assembly of (1) a unitary, molded member of a resilient material, molded walls of which define such cavity and terminate in a support surface of said seat, and a resiliently flexible wall of which encloses said cavity across from said at least one opening and at least one pedestal of which is supported by said resiliently flexible wall, and (2) at least one contact element, such at least one assembly being insertively mounted within and forming part of said housing.

13. A vacuum-type holder according to claim 12, wherein said at least one assembly is a plurality of assemblies, each of such assemblies being spacedly mounted with respect to said other assemblies within said housing.

14. A method of supportively retaining an article by vacuum, which comprises:

placing a surface of the article into contact with an opening of a vacuum cavity;

generating a vacuum within said cavity, such that a vacuum force draws the contacting surface of the article toward said opening of the cavity;

resiliently urging a wall of the cavity opposite to said opening to move toward said opening with a force acting in response to the vacuum generated within the cavity; and transferring said urging force acting on said wall through a support against said contacting surface, said urging force counteracting the vacuum force acting on the contacting surface in response to the vacuum, to alleviate a vacuum-related stress on said contacting surface of the article.

15. A method according to claim 14, wherein the article is a semiconductor wafer which is to be treated electrolytically, and placing a surface of the article into contact with an opening of a vacuum cavity comprises sealing a surface facing the cavity with a peripheral resilient seal from the ambient, and wherein transferring said urging force acting on said wall comprises urging electrically conductive support means into contact with the surface of the wafer facing the cavity, said urging force establishing electrical contact between said surface of the wafer while counteracting the force tending to draw the wafer toward the opening, whereby the wafer becomes supported against the vacuum-related stress on the wafer.

16. A method according to claim 15, wherein the electrically conductive support means is a contact element having a shaped contact surface, the method comprising urging the contact element into annular contact with the surface of the wafer facing the cavity.

17. A method according to claim 15, wherein the electrically conductive support means comprises a plurality of contact pins extending from said wall opposite to said opening through the cavity toward the wafer, the method comprising urging each of the plurality of pins into contact with the surface of the wafer facing the cavity, whereby the total of the force transferred through the pins equals said urging force acting on said wall and each of the pins applies to the wafer a predetermined fraction of the total transmitted force to the wafer.

18. a method according to claim 17, comprising guiding each of the pins into contact with the surface of the wafer facing the cavity.

* * * * *

UNITED STATES PATENT AND TRADEMARK OFFICE

CERTIFICATE OF CORRECTION

PATENT NO. : 4,428,815

DATED : January 31, 1984

INVENTOR(S) : W. W. Powell, G. A. Seifert

It is certified that error appears in the above—identified patent and that said Letters Patent is hereby corrected as shown below:

Column 4, line 53, "woth" should read --with--.
In the claims, Column 9, claim 10, line 52, "communication" should read --communicating--.

Signed and Sealed this

*Fifteenth* Day of *May 1984*

[SEAL]

*Attest:*

GERALD J. MOSSINGHOFF

*Attesting Officer*

*Commissioner of Patents and Trademarks*